US006312757B1

(12) United States Patent
Fort et al.

(10) Patent No.: US 6,312,757 B1
(45) **Date of Patent: *Nov. 6, 2001**

(54) CATHODE FOR DIAPHRAGM CHLOR-ALKALI ELECTROLYSIS CELL

(75) Inventors: Jean-Claude Fort, Fontvielle (FR); Corrado Mojana, Valmadrera; Pierluigi Borrione, Milan, both of (IT)

(73) Assignees: De Nora S.p.A. (IT); Elf Atochem S.A. (FR)

( * ) Notice: Subject to any disclaimer, the term of this patent is extended or adjusted under 35 U.S.C. 154(b) by 0 days.

This patent is subject to a terminal disclaimer.

(21) Appl. No.: 09/585,018

(22) Filed: Jun. 1, 2000

Related U.S. Application Data

(60) Continuation of application No. 09/413,379, filed on Oct. 6, 1999, now Pat. No. 6,093,442, which is a division of application No. 09/129,702, filed on Aug. 5, 1998, now Pat. No. 6,045,668.

(30) Foreign Application Priority Data

Aug. 8, 1997 (IT) ..... MI97A1920

(51) Int. Cl.[7] ..... B05D 5/12; B05D 3/00; C25B 11/00

(52) U.S. Cl. ..... 427/58; 427/295; 427/435; 204/280; 204/282; 204/293; 204/294

(58) Field of Search ..... 204/279, 252, 204/242, 280, 293, 294; 205/88; 427/58, 295, 345

(56) References Cited

U.S. PATENT DOCUMENTS

| | | | |
|---|---|---|---|
| 4,834,859 | | 5/1989 | Romine et al. . |
| 5,306,410 | | 4/1994 | Farmer . |
| 6,093,442 | * | 7/2000 | Fort et al. ..... 427/58 |

FOREIGN PATENT DOCUMENTS

| | | |
|---|---|---|
| 1671469 | 1/1972 | (DE) . |

* cited by examiner

*Primary Examiner*—Donald R. Valentine
(74) *Attorney, Agent, or Firm*—Bierman, Muserlian and Lucas

(57) ABSTRACT

The invention concerns a diaphragm chlor-alkali electrolysis cell comprising a cover, a conductive base for supporting the anodes and a cathode in the form of a box provided with internal wall, external wall and tubular fingers made of a mesh or perforated sheet covered with a porous diaphragm. One or more copper sheets for electric current distribution are fixed to the cathode external walls. The connection between the copper sheets and the cathode external walls is made by means of bolts with the interposition of a conductive and deformable element provided with residual elasticity under compression. The weldings for the assembling of the cathode walls are free from internal stresses.

5 Claims, 7 Drawing Sheets

CATHODE FOR DIAPHRAGM CHLOR-ALKALI ELECTROLYSIS CELL

PRIOR APPLICATIONS

This application is a continuation of U.S. patent application Ser. No. 09/413,379 filed Oct. 6, 1999, now U.S. Pat. No. 6,093,442 which is a division of U.S. patent application Ser. No. 09/129,702 filed Aug. 5, 1998, now U.S. Pat. No. 6,045,668.

BACKGROUND

The production of chlorine and caustic soda by electrolysis of aqueous solutions of sodium chloride (hereinafter defined as brine) is one of the most important industrial processes. Chlorine, in fact, Is the raw material necessary for obtaining a large variety of solvents, chemical intermediates and plastic materials, such as perchloroethylene, propylene oxide, polyvinylchloride and polyurethane.

Chlor-alkali electrolysis is currently carried out resorting to three different technologies, that is diaphragm, mercury cathode and membrane. The membrane technology has been developed in recent years and is currently used for the construction of new plants. However, great part of the worldwide production of chlorine and caustic soda is still obtained by the diaphragm and mercury technologies, which experienced a slow evolution with time in terms of energy saving, reliability of operation and control of the pollution due to possible release of the fibers used for producing the diaphragm or mercury leaks. This continuous improvement in fact made less interesting under an economical point of view the replacement of existing diaphragm or mercury plants with the modern membrane cells.

In particular, as concerns diaphragm cells, which are the object of the present invention, their structure is essentially made of three parts: a cover, a base on which the anodes are fixed and a cathode provided with internally hollow elements with a rather flat section, known as fingers, interleaved with the anodes.

The base structure is clearly illustrated in U.S. Pat. No. 3,591,483. It preferably comprises a conductive sheet, such as a copper plate, provided with holes, to which the anodes are fixed. The side of the plate facing the anodes is protected by a rubber sheet or preferably a thin sheet of titanium.

The anodes may be in the form of a box, as described in U.S. Pat. No. 3,591,483. However, in a more advanced solution, as described in U.S. Pat. No. 3,674,676, the anodes comprise two opposed movable surfaces supported by flexible means which permit their expansions with the minimization of the anode-cathode fingers distance and the consequent reduction of the cell voltage, that is the energy consumption.

The cathode structure is still today the one described in U.S. Pat. No. 3,390,072. It comprises a hollow box (without cover and base), the external wall of which is made of four carbon steel plates welded along their vertical edges. The box is further provided with an internal wall having welded thereto the fingers made of a perforated sheet or a metal mesh, covered by a porous diaphragm. The geometry of the connections between the external, internal walls and fingers has been optimized as described in DE 4117521A1, which specifies the dimensions of the various parts allowing for minimizing the corrosive action of the catholyte on the carbon steel. The porous diaphragm deposited onto the fingers is made of a mixture containing fibers of asbestos or other inert materials such as zirconium oxide, and a polymeric material. The mixture, in a suitable aqueous suspension, is deposited by vacuum filtering. The polymeric material provides for a binding function obtained by subjecting the cathode, with the diaphragm deposited onto its fingers, to a thermal treatment at 250–350° C. in a suitable oven. The proper temperature and necessary time are selected depending on the polymeric material used. Suitable materials are polymers with different degrees of fluorination, such as polyvinylidenfluoride, ethylene-chlorotrifluoroethylene copolymers, polytetrafluoroethylene.

In order to improve the current distribution to the fingers, the thickness of the external wall must be suitably selected. The aforementioned U.S. Pat. No. 3,390,072 describes the use of one or more copper sheets applied to the external wall to avoid using excessively thick carbon steel plates. These copper sheets may be applied by arc welding or explosion bonding. This second method, although much more expensive, is commonly preferred as it ensures a homogeneous electrical contact over all the interface between copper and carbon steel. In the case of copper sheets applied by arc welding, conversely, the electrical contact is essentially localized on the welding areas. Therefore, in this last case, the copper sheets are less efficient in homogeneously distributing electric current among the various fingers and minimizing the ohmic losses, that is the dispersion of electric energy due to the electrical resistance of the structure. While the performance of both the cover and the conductive base provided with the anodes is satisfactory, the cathode, as previously illustrated, is negatively affected by rather serious inconveniences, which the present invention intends to overcome, as explained in the following discussion. These inconveniences may be summarized as follows:

a) fractures in the welding areas connecting the plates of the external wall, the internal wall and the cathode fingers. This problem, known in the art, is well depicted on the figure at page 176 of the "Corrosion Data Survey", NACE Editions, 1985. From the figure it is soon clear that certain combinations between caustic soda concentration and temperature cause fractures in the carbon steel parts with internal stresses, such as the weld heads. The figure indicates also that the fractures are eliminated if the carbon steel parts are subjected to a stress-relieving thermal treatment. This treatment, consisting In heating at 600° C. for about one hour, cannot be applied to cathodes of the prior art due to the strong differences between the thermal expansion coefficients of carbon steel and copper, which would cause remarkable distortions. On the other hand, a thermal treatment only on the carbon steel structure would be useless, as the subsequent welding of the copper sheets would again involve internal stresses. This situation imposes limitations of both the concentration of the caustic soda produced at the cathode and of the electrolysis temperature, which reduce but do nor eliminate the risk of fractures.

b) Distortions of the cathode structure and fractures in the welding areas between the copper sheet and the carbon steel walls due to thermal fatigue during the diaphragm stabilization phase at 250–350° C. These problems are also due to the different thermal expansion coefficients of copper and carbon steel, as discussed before. Even if the diaphragm stabilization temperatures are substantially lower than those typical of the stress-relieving treatment, the inconveniences are likewise severe as the most commonly used diaphragms today have an average life of 9–15 months and therefore their preparation, including stabilization, is repeated more than once during the operating lifetime of a cathode.

c) Copper salt pollution of the suspension used for depositing the diaphragm.

As the cathode is totally immersed in the tank containing the suspension and as the suspension contains remarkable quantities of chlorides and is saturated with air, unavoidably both the carbon steel parts and the copper parts are subjected to corrosion. The progressive build-up of copper concentration in the suspension may lead to a decay of the diaphragm quality, in particular of the most valuable ones which are foreseen for a longer operating life.

It is an object of the present invention to provide a novel cathode structure made of detachable parts, which overcomes all the above mentioned prior art drawbacks.

DESCRIPTION OF THE INVENTION

The present invention concerns a chlor-alkali diaphragm electrolysis cell equipped with an improved cathode characterized In that the copper sheet or sheets for the electric current distribution are not integral with the cathode but can be easily disconnected. Therefore the carbon steel structure, after assembling of the various parts by welding, but without copper sheets, may be subjected to a thermal stress-relieving treatment before operation in the electrolysis cell. Further the carbon steel structure may be sent alone to oven for stabilization of the porous diaphragm after each re-deposition. In order to improve the current distribution between the carbon steel structure and the copper sheet or sheets a highly conductive element is interposed, which may be made of either a deformable layer interposed between the copper sheet and the steel surface of the external wall or a layer thermally applied to the steel surface, or a combination of the same. By the present invention, fractures during operation, distortions during the diaphragm stabilization phase and pollution of the aqueous suspensions used for the diaphragm deposition, that is all the inconveniences negatively affecting the prior art cathodes, are avoided. Further, with the cathodes of the present invention, any limitation of the produced caustic soda concentration and electrolysis temperature may be due exclusively to process reasons and not to the need of maintaining the integrity of the cathode structure with time.

The invention will be illustrated making reference to the figures, wherein.

Figure 1:
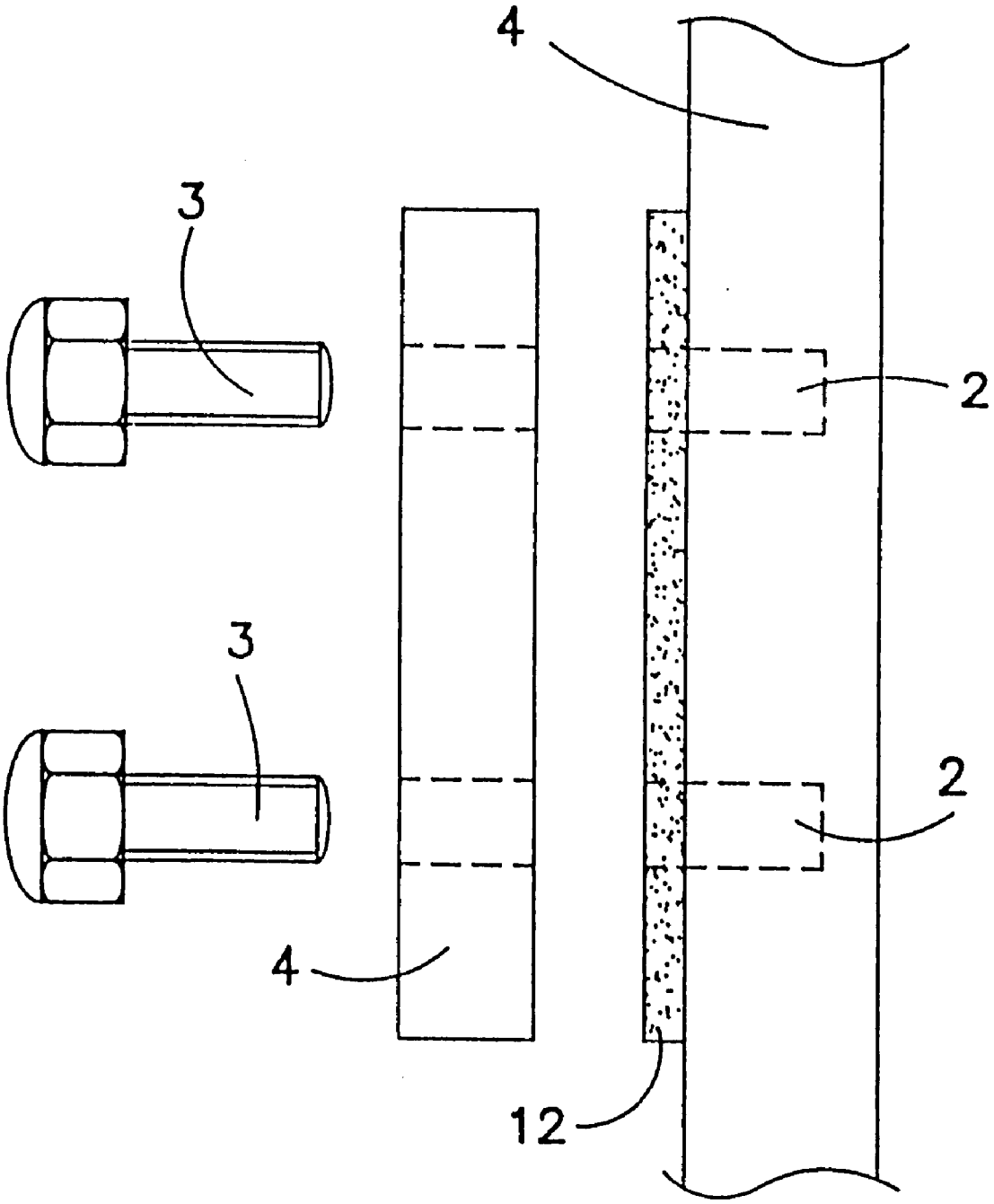
FIG. 1, 2 and 3 are exploded views of the components of the connection system between the copper sheet and the external carbon steel wall of the cathode of the invention.

In FIG. 1, the external wall 1 of the cathode of the invention is provided with threaded holes 2 to house bolts 3, capable of pressing the copper sheet 4 against said external wall. The external wall 1 is provided with a highly conductive element 12, which consists of a metal layer applied thereto by thermal spraying methods, such as flame or plasma spraying. Contrary to the teaching of any prior art, the setting of the spraying machine is such that the layer of the conductive element 12 is provided with a porosity. The experimental data have shown that the porosity, defined as the ratio of void-to-solid volume, should be at least 10% and preferably 20 to 30%. The porosity is needed because, upon assembling the components shown in FIG. 1 a certain deformability of the conductive element 12 is required to compensate for all deviations from planarity of the contacting surfaces.

Figure 2:
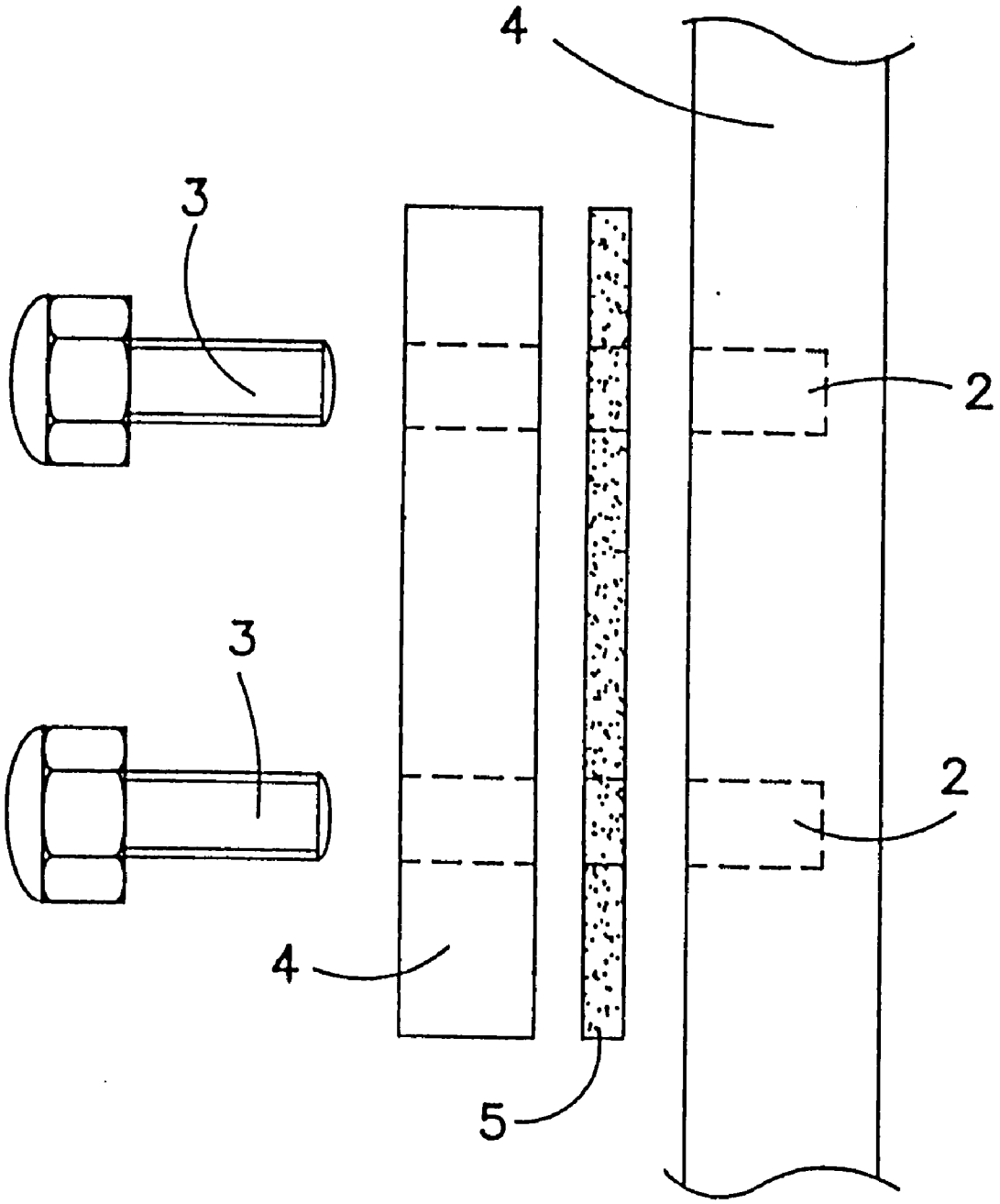

Making now reference to FIG. 2, a further embodiment of the invention is illustrated, where the highly conductive element 5 which separates the copper sheet 4 and the external wall 1 is a material exhibiting deformation properties and residual elasticity upon deformation. This material may be selected in the group comprising single or superimposed meshes, unflattened expanded sheets, metal foams; such as for example the type commercialized by Sumitomo, Japan, under the commercial name of Cellmet®.

Figure 3:
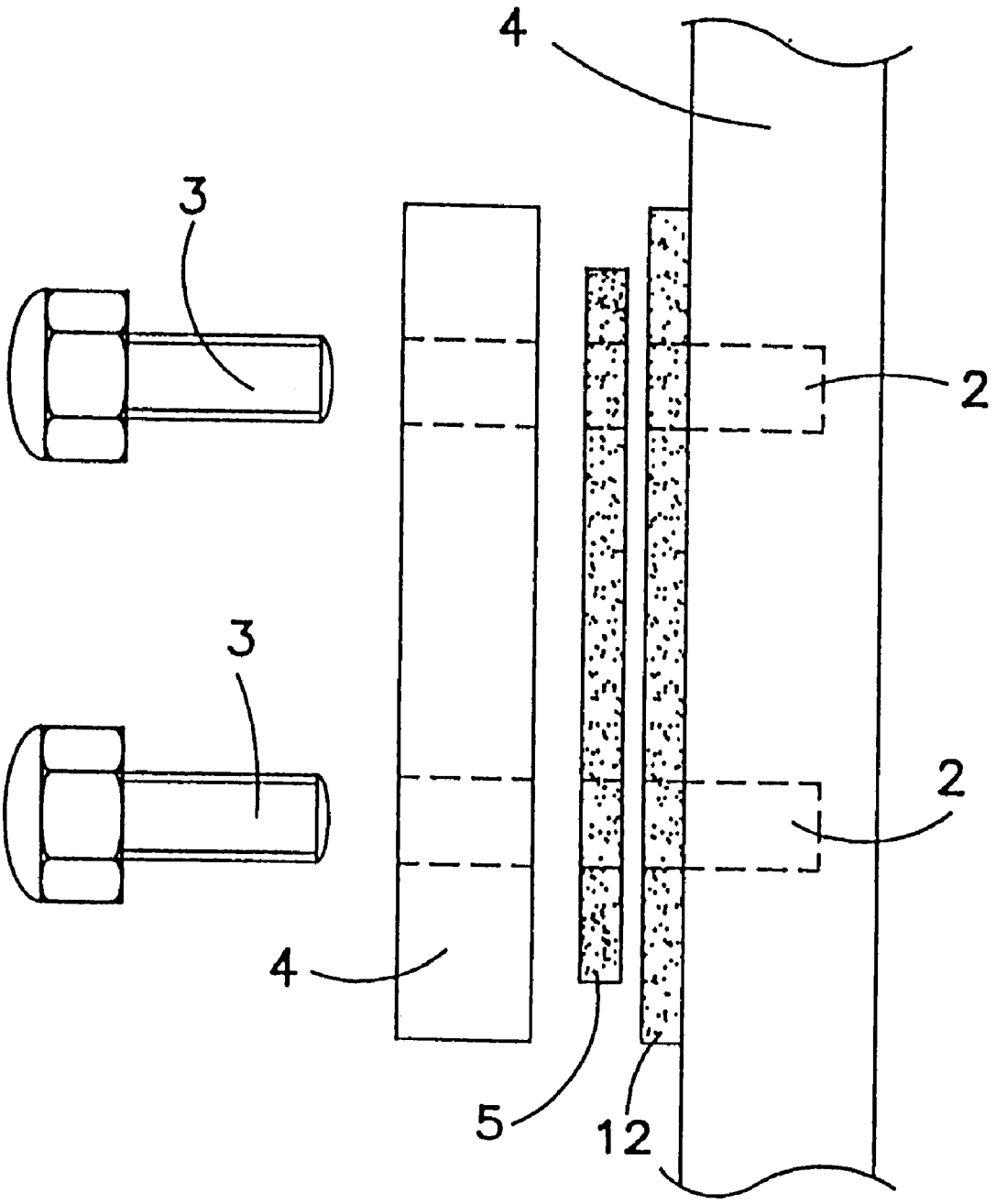

FIG. 3 represents a particularly preferred embodiment of the invention, wherein the external wall 1 of the cathode of the invention is provided with the conductive element 12 of FIG. 1 and the deformable element 5 of FIG. 2 is further positioned between the external wall 1 and the copper sheet 4. In this case both elements 5 and 12 cooperate to deformate as much as required for an optimum continuous contact between the surfaces of wall 1 and copper sheet 4; in addition element 12 provides the lowest resistance interface both towards the external wall 1 thanks to the metallurgical bond between the carbon steel of wall 1 and the sprayed metal particles and towards the element 5 thanks to the conductive oxide surface typical of the metals of both elements 5 and 12.

Figure 4:
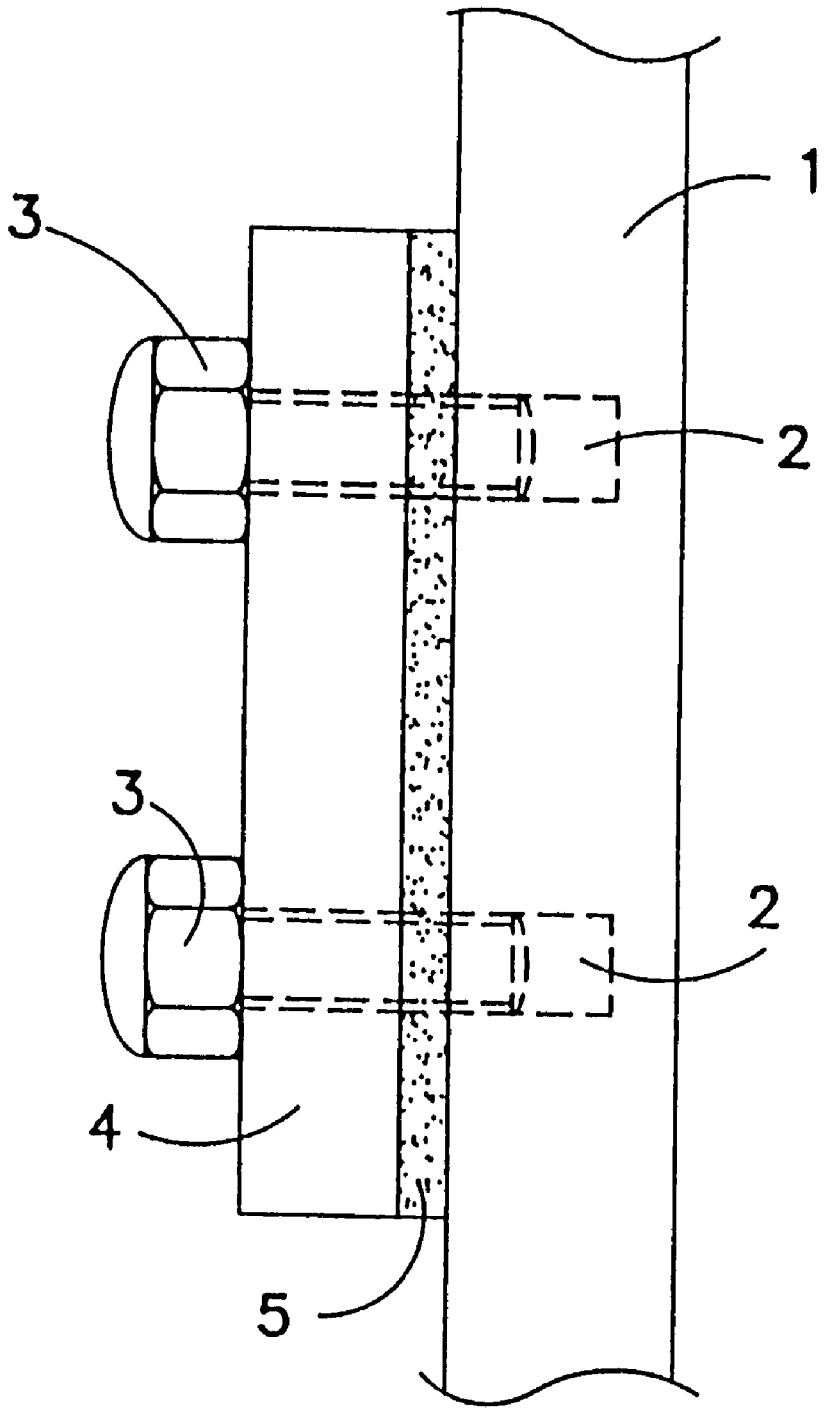
FIG. 4 illustrates the system of FIG. 2 after assembling

When the components of FIG. 2 are assembled together (FIG. 4), each bolt 3 can apply a load in the range of 5–10 tons, with a pressure among the copper sheet 4, the deformable conductive element 5 and the external wall 1 in the range of 0.5–2 kg/mm$^2$.

Figure 5:
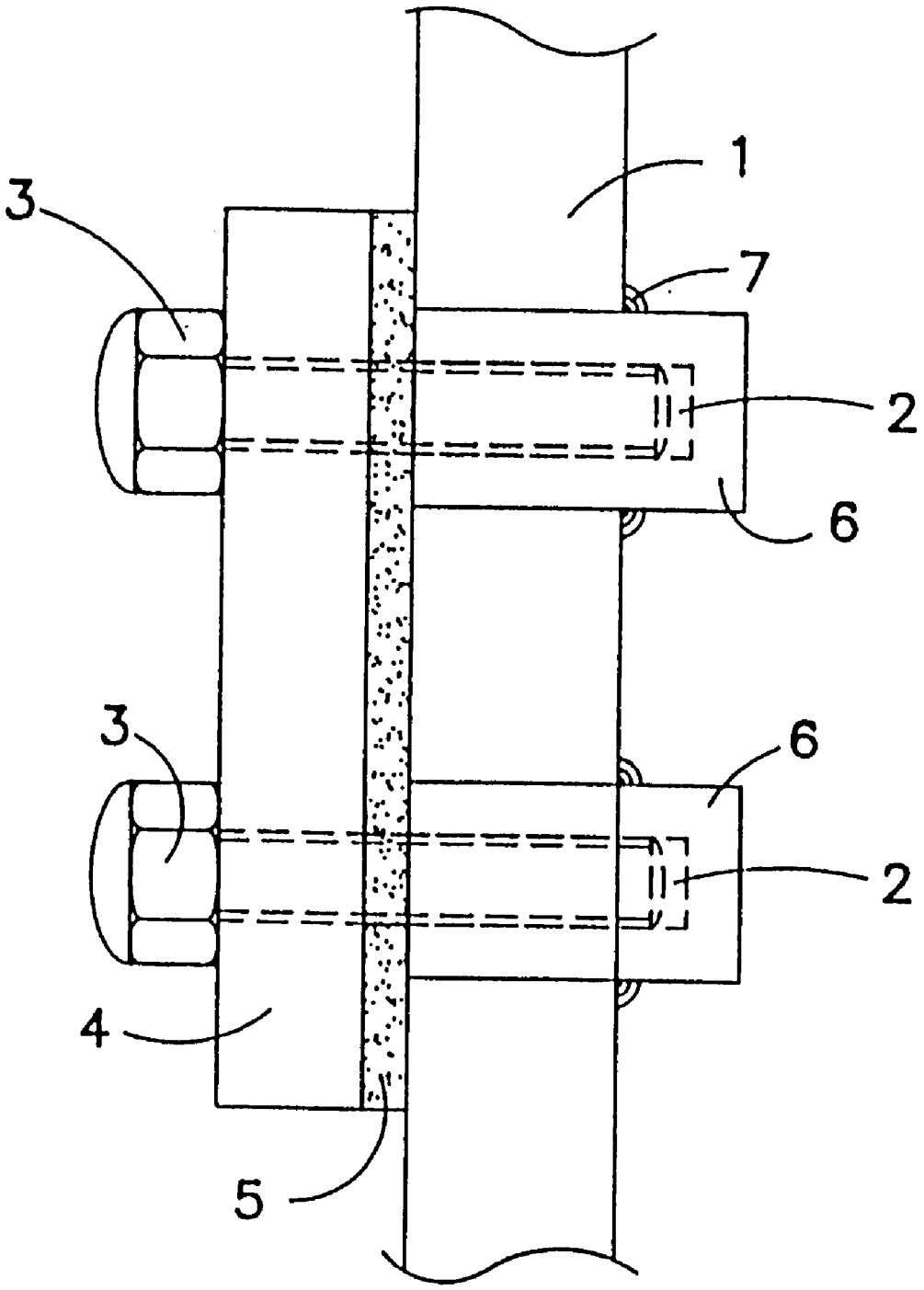
FIG. 5 shows a different design of the bolting arrangement of FIG. 4.

As shown in FIG. 5, in order to improve the stability of the contact pressure, the threaded holes 2 may be obtained in a socket 6 fixed by weldings 7 onto the side of external wall 1 opposite to that in contact with the copper sheet 4. Further, between the head of bolt 3 and the copper sheet 4 a suitable spring, not shown in the figures for simplicity sake, may be inserted in order to keep the pressure exerted by the bolt as constant as possible, independently from the dimensional modifications caused by temperature variations.

The connection between the copper sheet 4 and the external wall 1 of the invention may be provided with a peripheral gasket, not shown In the figures, which ensures for sealing the contact area and avoids the risk of corrosion in the contact interface area due to the aggressive agents which may be present in the surrounding environment. The gasket has also the function of avoiding that possible washing liquids of the electrolysis cell may penetrate in the contact area causing rusting of the carbon steel surface. The carbon steel surface needs only to be oxide-free, which is easily obtained by sand-blasting. As explained before, there Is no need for machining, since possible profile deviations are readily compensated by the conductive elements 5 and/or 12 of the invention.

Figure 6:
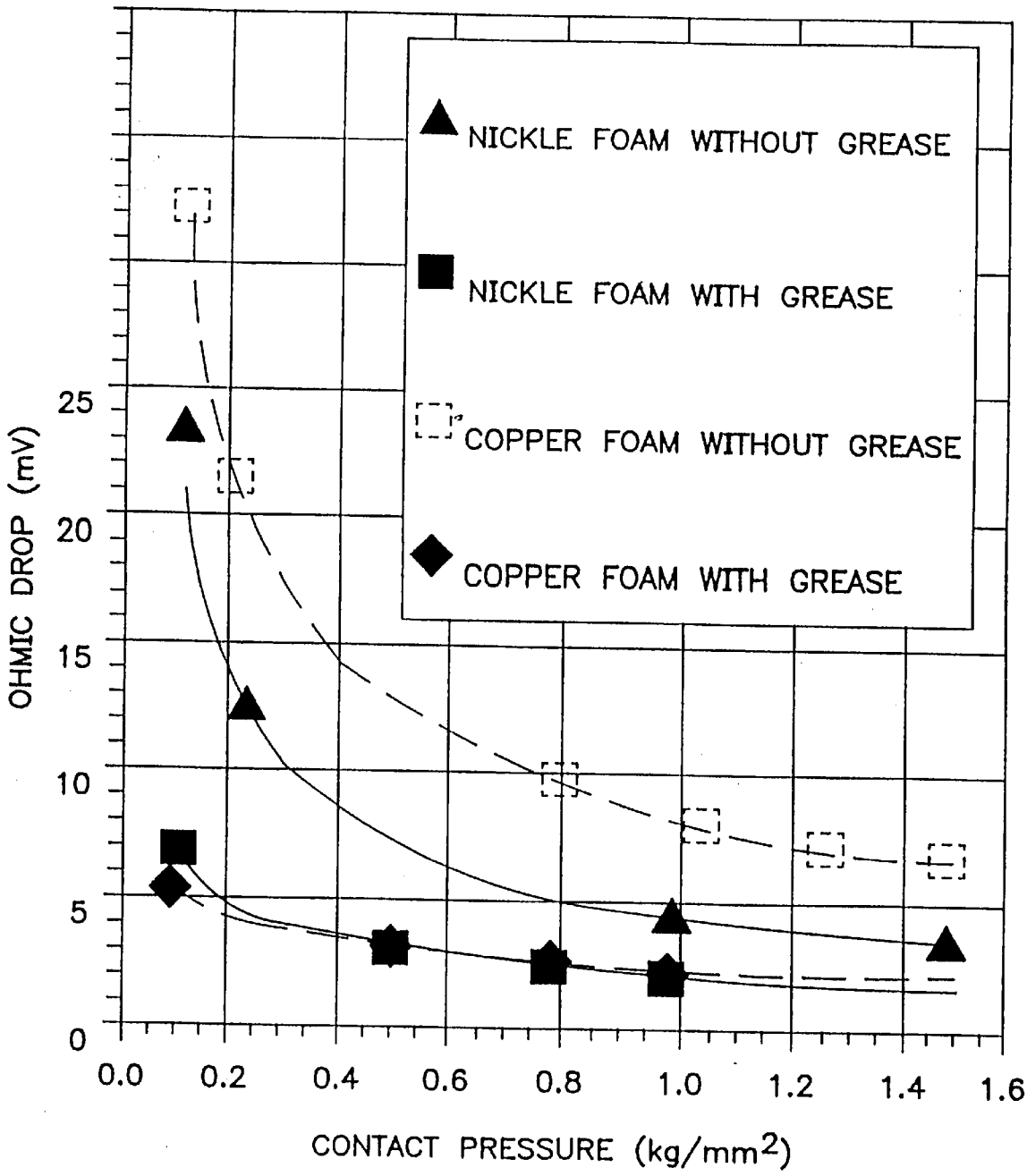
FIG. 6 is a diagram showing the ohmic drop at the connection of FIG. 2 as a function of both the different materials and the mechanical load applied by means of bolts.

FIG. 6 shows the ohmic drops of the cathode connection of FIG. 2 as a function of the clamping pressure, the type of conductive element and the improvement achieved through the addition of a conductive grease, such as Alcoa EJC, No. 2. The current density across the connection is 0.25 A/mm$^2$, that is about twice the current density typical of normal industrial operation.

As concerns the type of metal used for conductive elements 5 and 12, the results obtained indicate that silver or nickel ensure better performances than copper, but the latter is also acceptable. When a metal foam is used as in the connection of FIG. 2, it can be characterized by 80 pores per inch (ppi), the behavior of which is shown in FIG. 6. However, also with 30 pores per inch acceptable results have been obtained. Only with coarser foams, in the order of about 7 ppi, the results have been less satisfactory.

Figure 7:
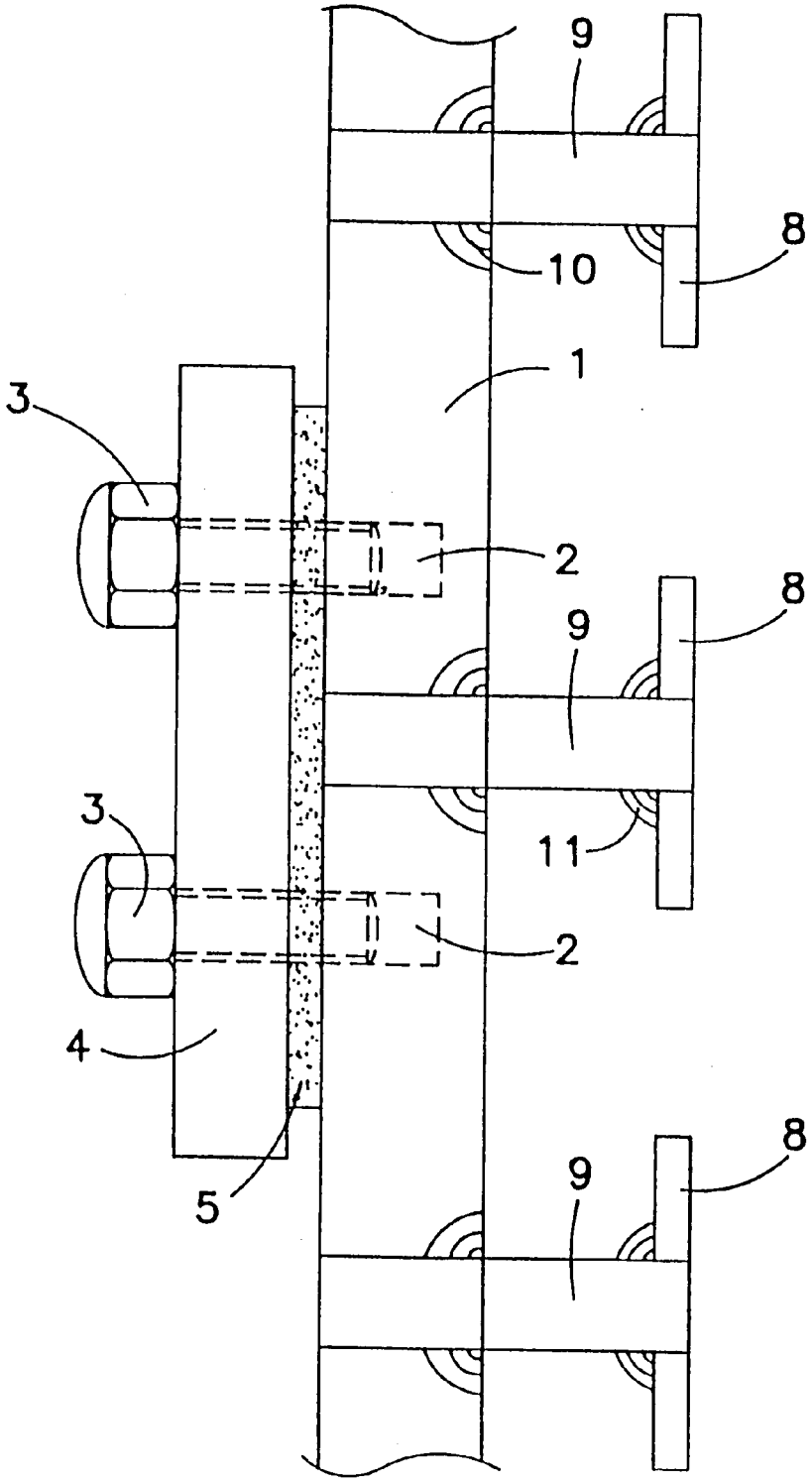
FIG. 7 is a sketch of a further transversal section of an external wall of the cathode of the invention including the connection system of FIG. 2.

FIG. 7 shows a transversal cross-section of the external wall of an improved cathode, provided with the connection system of the invention and with pins for current transmission. The various parts are identified by the same numerals used in the other figures. The internal wall 8 has various anode fingers fixed thereto and pins 9 are fixed by weldings 10 and 11 to the external wall 1 and internal wall 8. The pins 9 permit to transfer electric current directly from the contact area between the copper sheet 4 and the external wall 1 to the internal wall 8 and then to the fingers covered by the diaphragm. This arrangement permits to shorten the electric current path from the copper sheet to the fingers and therefore to reduce the ohmic drops, that is dispersion of electric energy. The use of pins is known in the art but was limited to the upper and lower portions of the external wall with respect to the copper sheet. In fact, so far it was not possible to weld pins in correspondence to the central area of the copper sheet to avoid damaging the carbon steel/copper interface. The present invention solves this problem as the copper sheets are applied only subsequently and therefore such a limitation is eliminated.

A further aim of the present invention is to provide a process for the preparation of the cathode for the cell of the present invention. This process is directed towards the preparation of a cathode whose weld are free of internal stresses. This is obtained by subjecting the structure made of carbon steel, free of the copper plates, to a stress-relieving heat treatment, as a guide at 550–600° C. for one hour. The carbon steel structure is subsequently subjected to the process for depositing the diaphragm.

A further aim of the present invention is to provide a process for the preparation of the cell diaphragm. This process Is characterized in that the carbon steel structure of the cathode, which has been thermally relaxed, and is again free of copper plates, is subjected to deposition of the diaphragm according to the known procedures and to its stabilization by treatment in an oven, as a guide at 250–350° C. depending on the type of polymeric binder used. Only at the end of this treatment is the cathode structure connected to the copper plates, as described above.

Even if the invention has been described making reference to specific embodiments, it must be understood that modifications, substitutions, omissions and changes of the same are possible without departing from the spirit thereof and are intended to be encompassed in the appended claims.

What is claimed is:

1. A cathode for a diaphragm chlor-alkali electrolysis cell comprising carbon steel plates welded together in the form of a box with external walls and internal walls, at least one copper sheet bolted to the external wall of the box and an electrically conductive element interposed between the said copper sheet and external wall consisting of a metal layer applied to at least one of the copper sheet and the external wall, the copper sheet and external wall being easily disconnected and the welds of the carbon steel plates being free from internal stress.

2. The cathode of claim 1 wherein said metal layer is applied by at least one thermal spraying method.

3. The cathode of claim 2 wherein said metal layer is provided with a porosity of 20 to 30% defined as the ratio of void-to-solid volume.

4. The cathode of claim 1 wherein the welds are thermally stress-relieved without the copper sheets.

5. A process for the preparation of a diaphragm for use in an electrolysis cell comprising immersing a cathode comprising carbon steel plates welded together in the form of a box with external walls and internal walls, at least one of said external walls adapted to receive at least one copper sheet secured thereto, in a suspension of fibers and polymeric binders;

subjecting the latter to vacuum filtration to deposit the diaphragm thereon;

securing with bolts said at least one copper sheet and an electrically conductive element in between to said at least one external wall, said conductive element being a metal layer applied to at least one of the copper sheet and the external wall.

* * * * *